US009887471B2

(12) United States Patent
France et al.

(10) Patent No.: US 9,887,471 B2
(45) Date of Patent: Feb. 6, 2018

(54) ELECTRICAL APPARATUS HAVING A PUSH-IN CONNECTION TERMINAL WITH A SUPPORT CLIP GUIDING AND LIMITING THE ELASTIC DEFORMATION OF THE CONTACT SPRING

(71) Applicant: ABB SCHWEIZ AG, Baden (CH)

(72) Inventors: Philippe France, Chazelles sur Lyon (FR); Romain Villard, Saint Priest (FR); Moine Geoffrey, Lyons (FR)

(73) Assignee: ABB SCHWEIZ AG, Baden (CH)

( * ) Notice: Subject to any disclaimer, the term of this patent is extended or adjusted under 35 U.S.C. 154(b) by 0 days.

(21) Appl. No.: 15/432,617

(22) Filed: Feb. 14, 2017

(65) Prior Publication Data

US 2017/0237186 A1 Aug. 17, 2017

(30) Foreign Application Priority Data

Feb. 15, 2016 (EP) ..... 16305168

(51) Int. Cl.
*H01R 11/20* (2006.01)
*H01R 9/24* (2006.01)
(Continued)

(52) U.S. Cl.
CPC ..... *H01R 9/2416* (2013.01); *H01R 4/4827* (2013.01); *H01R 9/26* (2013.01)

(58) Field of Classification Search
CPC .. H01R 4/2433; H01R 4/2404; H01R 4/2412; H01R 4/40; H01R 4/2491; H01R 11/282
(Continued)

(56) References Cited

U.S. PATENT DOCUMENTS 5,494,456 A * 2/1996 Kozel ..... H01R 4/4827 439/439
6,074,242 A * 6/2000 Stefaniu ..... H01R 4/4827 439/441

(Continued)

FOREIGN PATENT DOCUMENTS

DE 102005016534 A1 10/2016
FR 2792778 A1 10/2000
FR 3012686 A1 5/2015

OTHER PUBLICATIONS

FR3012686 English Abstract.

(Continued)

*Primary Examiner* — Phuong Chi T Nguyen
(74) *Attorney, Agent, or Firm* — Cantor Colburn LLP

(57) ABSTRACT

An electrical apparatus such as an electrical contactor or a terminal block, comprises a casing made of an electrically insulating material, a conductive bar mounted in the casing and at least one push-in type connection terminal. The terminal comprises a contact spring having an elastic portion undergoing an elastic deformation under the action of an external force applied on the contact spring either by an electrical conductor during its insertion at a first aperture of the casing so as to place the electrical conductor in a contact position located between the contact spring and the conductive bar in order to establish an electrical connection between the electrical conductor and the conductive bar, or by a tool inserted into a second aperture of the casing so as to open the contact spring and release the electrical conductor in order to remove it out of its contact position. The electrical apparatus comprises a support clip independent of the casing and of the conductive bar. The clip comprises fastening elements allowing mounting of the support clip on the contact spring and delimits a bearing face against which the contact spring bears during the deformation of its elastic (Continued)

portion under the action of the external force in order to impose the manner in which the elastic portion spatially deforms and against which the contact spring abuts in its maximum deformation state in order to limit the elastic deformation of the elastic portion of the contact spring below a predetermined value regardless of the intensity of the external force.

20 Claims, 4 Drawing Sheets

(51) Int. Cl.
*H01R 4/48* (2006.01)
*H01R 9/26* (2006.01)

(58) Field of Classification Search
USPC ..... 439/409, 391, 410, 432–436, 387, 393
See application file for complete search history.

(56) References Cited

U.S. PATENT DOCUMENTS

| | | | | |
|---|---|---|---|---|
| 6,196,883 | B1 * | 3/2001 | Bechaz | H01R 4/4845 439/789 |
| 6,283,801 | B1 | 9/2001 | Guinda et al. | |
| 6,719,581 | B2 * | 4/2004 | Kikuchi | H04R 5/04 439/441 |
| 6,786,779 | B2 * | 9/2004 | Feldmeier | H01R 13/506 439/729 |
| 2014/0127932 | A1 | 5/2014 | Hoppmann et al. | |

OTHER PUBLICATIONS

DE102005016534 English Abstract.
FR2792778 English Abstract.
European Search Report for Application No. EP16305168.

* cited by examiner

ELECTRICAL APPARATUS HAVING A PUSH-IN CONNECTION TERMINAL WITH A SUPPORT CLIP GUIDING AND LIMITING THE ELASTIC DEFORMATION OF THE CONTACT SPRING

CROSS REFERENCE TO RELATED APPLICATIONS

This application claims foreign priority under 35 U.S.C. § 119 to European Patent Application No. 16305168.3 filed on Feb. 15, 2016, the entire contents of which are incorporated herein by reference thereto.

BACKGROUND

The present invention concerns an electrical apparatus such as an electrical contactor or a terminal block, comprising a casing made of an electrically insulating material, a conductive bar mounted in the casing and at least one push-in type connection terminal comprising a contact spring having an elastic portion undergoing an elastic deformation under the action of an external force applied on the contact spring by an electrical conductor during its insertion at a first aperture of the casing so as to place the electrical conductor in a contact position located between the contact spring and the conductive bar in order to establish an electrical connection between the electrical conductor and the conductive bar, or by a tool inserted into a second aperture of the casing so as to open the contact spring and release the electrical conductor in order to remove it out of its contact position.

It is known to design an electrical apparatus with at least one push-in type connection terminal mounted in the electrically insulating casing together with the electrical connection conductive bar. This technical solution may be provided in particular in the electrical apparatus of the terminal block type.

The contact spring is configured such that the contact between the electrical conductor and the conductive bar results from a forced insertion of the electrical conductor in opposition to the action of the contact spring and is automatically maintained by the contact spring after the insertion of the electrical conductor. The insertion of the electrical conductor in what is here called <<the contact position>> is practiced between a portion of the contact spring and the conductive bar, such that the electrical conductor is directly clasped by and between these two parts. The electrical conductor may, for example, come into an aperture formed in the conductive bar and be held by the contact spring itself mounted on the conductive bar.

The removal of the electrical conductor is then practiced by exerting an external force on the contact spring via a tool tending to open the spring in order to release the electrical conductor.

In these known solutions equipped with push-in connection terminals, the casing is generally made into two portions assembled to one another in a lateral direction perpendicular to the insertion direction of the electrical conductor into the connection terminal and perpendicular to the plane in which the contact spring elastically deforms during use.

This results in a limitation of the freedom of design of the connection terminal and it may occur that the electrical apparatus as a whole is not totally satisfactory, in particular in terms of cost, simplicity of design and use, ergonomics, bulk and weight.

Moreover, it is known to equip the casing with inner elements integral with the rest of the casing and provided to cooperate with the contact spring during its elastic deformation so as to guide and limit the elastic deformation of the contact spring.

Though such elements are satisfactory when the casing is laterally assembled into two portions, they are inappropriate when the situation is different, in particular in the case of electrical apparatuses whose casing comprises two portions assembled together according to a direction substantially parallel to the insertion direction of the electrical conductor in the terminal, as is for example the case in an electrical contactor having conventionally a casing constituted by the assembly of a lower peripheral wall and an upper cover. Indeed, such inner elements would completely prevent the mounting of the connection terminal inside the casing.

The present invention aims to solve all or part of the drawbacks listed hereinabove.

In this context, there is a need to provide an electrical apparatus corresponding to the technical field presented hereinabove and which allows proposing an alternative solution to the existing solutions, avoiding the risks of damage to the contact spring, improving aspects such as costs, bulk and weight, being simple in design and use, while being user-friendly and ergonomic in practice.

BRIEF SUMMARY

To this end, there is provided an electrical apparatus such as an electrical contactor or a terminal block, comprising a casing made of an electrically insulating material, a conductive bar mounted in the casing and at least one push-in type connection terminal comprising a contact spring having an elastic portion undergoing an elastic deformation under the action of an external force applied on the contact spring by an electrical conductor during its insertion at a first aperture of the casing so as to place the electrical conductor in a contact position located between the contact spring and the conductive bar in order to establish an electrical connection between the electrical conductor and the conductive bar, or by a tool inserted into a second aperture of the casing so as to open the contact spring and release the electrical conductor in order to remove it out of its contact position, the electrical apparatus comprising a support clip independent of the casing and of the conductive bar, having fastening elements allowing mounting the support clip on the contact spring and delimiting a bearing face against which the contact spring bears during the deformation of its elastic portion under the action of the external force in order to impose the manner in which the elastic portion spatially deforms and against which the contact spring abuts in its maximum deformation state in order to limit the elastic deformation of the elastic portion of the contact spring below a predetermined value regardless of the intensity of the external force.

According to a particular embodiment, the support clip is an integral single piece.

The fastening elements may comprise coupling elements in the form of a hook secured to the support clip and arranged to be reversibly hooked into a complementary area of the contact spring.

According to another embodiment, the support clip and the contact spring are configured such that the support clip is fixed on the contact spring by a relative displacement of the support clip relative to the contact spring in a lateral mounting direction substantially perpendicular to a deformation plane in which the contact spring deforms during the elastic deformation of its elastic portion under the action of the external force.

The contact spring may comprise at least one elongated blade where all or part of the elastic portion of the contact spring is arranged and the support clip may be fastened on said at least one blade in order to occupy an operative position relative to the blade in which the support clip blocks and limits the elastic deformation of the blade when the elastic portion of the contact spring deforms under the action of the external force.

According to a particular embodiment, the support clip is mounted on said at least one blade in a lateral direction of said blade until it occupies its operative position.

Said at least one blade may be bent along its length so as to delimit an elbow, in particular in the range of 180°, and the support clip may be housed in said elbow when it occupies its operative position.

According to a particular embodiment, the fastening elements of the support clip comprise at least one bearing element secured to the support clip configured to bear against the contact spring in order to prevent the tilting of the support clip relative to the contact spring under the effect of the weight of the support clip.

The bearing element may be constituted by a protuberance of the support clip configured to bear against a portion of the contact spring projecting relative to said at least one blade in a direction lateral to the blade, said bearing being exerted in a longitudinal direction of the blade.

The bearing element may alternatively be constituted by an external cap of the support clip configured to surround the elbow delimited by said at least one blade and to bear on the outer face of said elbow, said bearing being exerted in a transverse direction of the blade.

According to a preferred embodiment, the casing comprises two portions assembled to one another in a mounting direction orientated substantially parallel to the direction of displacement of the electrical conductor during its insertion until its contact position.

The mounting direction of the assembly constituted by the contact spring and the support clip assembled to each other into the casing may be orientated substantially parallel to the direction of displacement of the electrical conductor during its insertion until its contact position.

BRIEF DESCRIPTION OF THE DRAWINGS

The invention will be well understood using the following description of particular embodiments of the invention given as non-limiting examples and represented in the appended drawings, in which.

DETAILED DESCRIPTION

Figure 1:
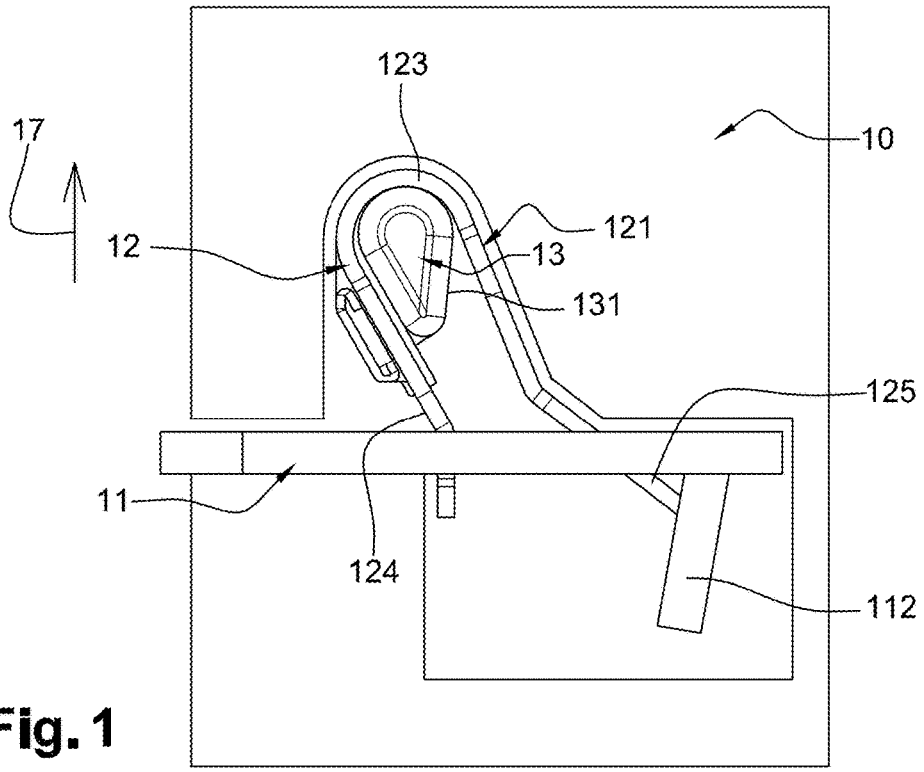
FIG. 1 is a front view of an example of an electrical apparatus according to the invention.
Figure 2:
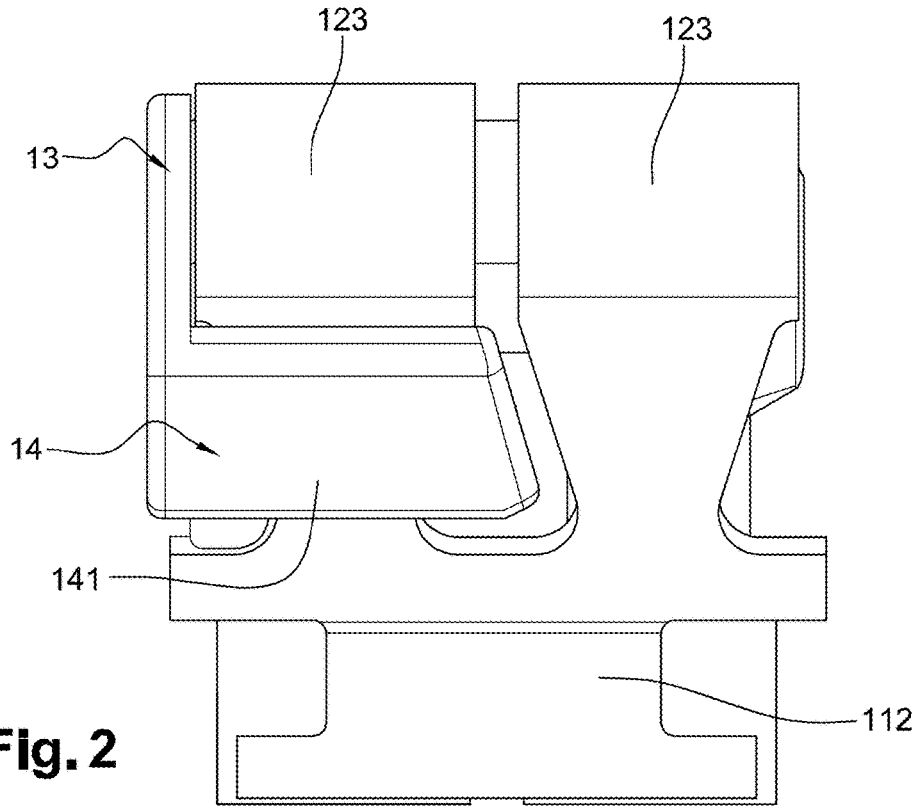
FIG. 2 is a side view of the assembly constituted by the conductive bar, the contact spring and the support clip used in FIG. 1.
Figure 3:
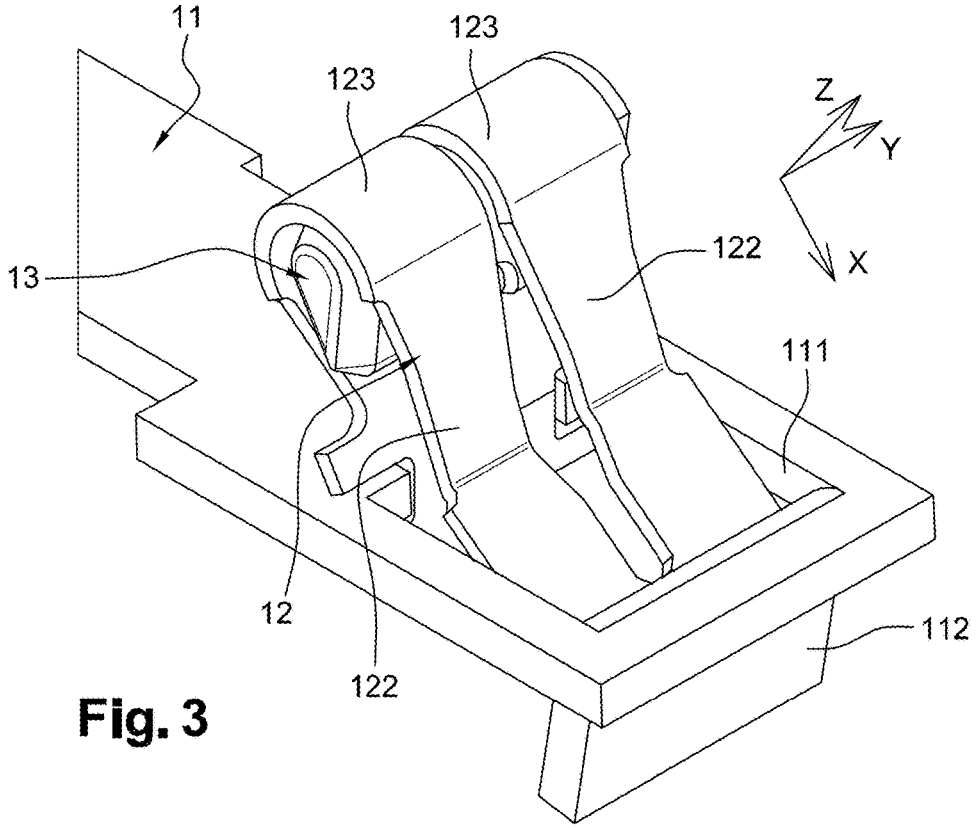
FIGS. 3 and 4 are perspective views along two opposite angles of the parts of FIG. 2.
Figure 4:
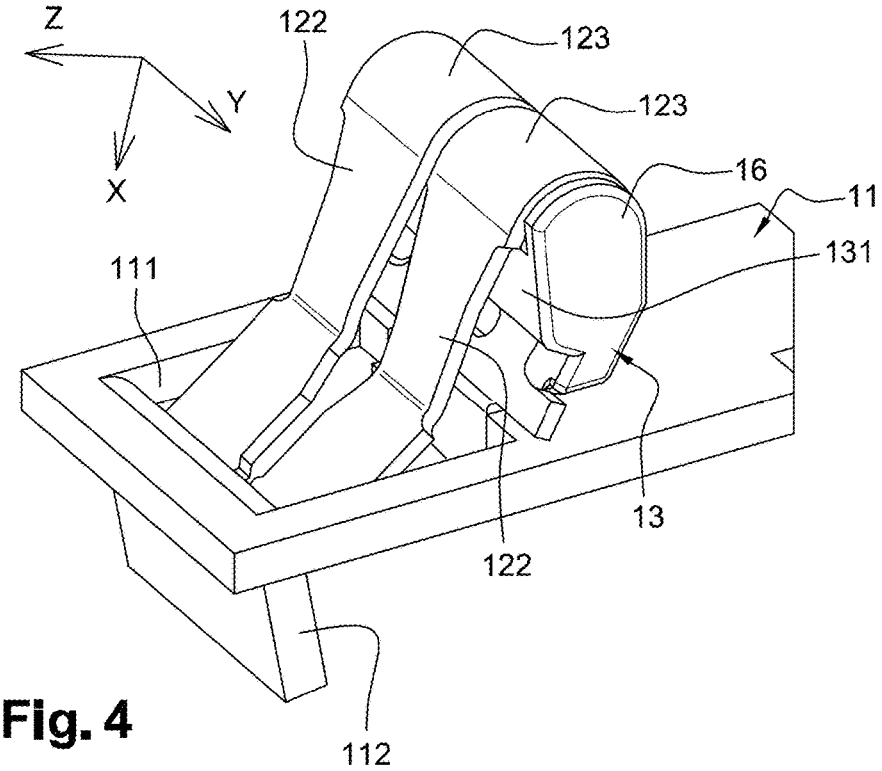
Figure 5:
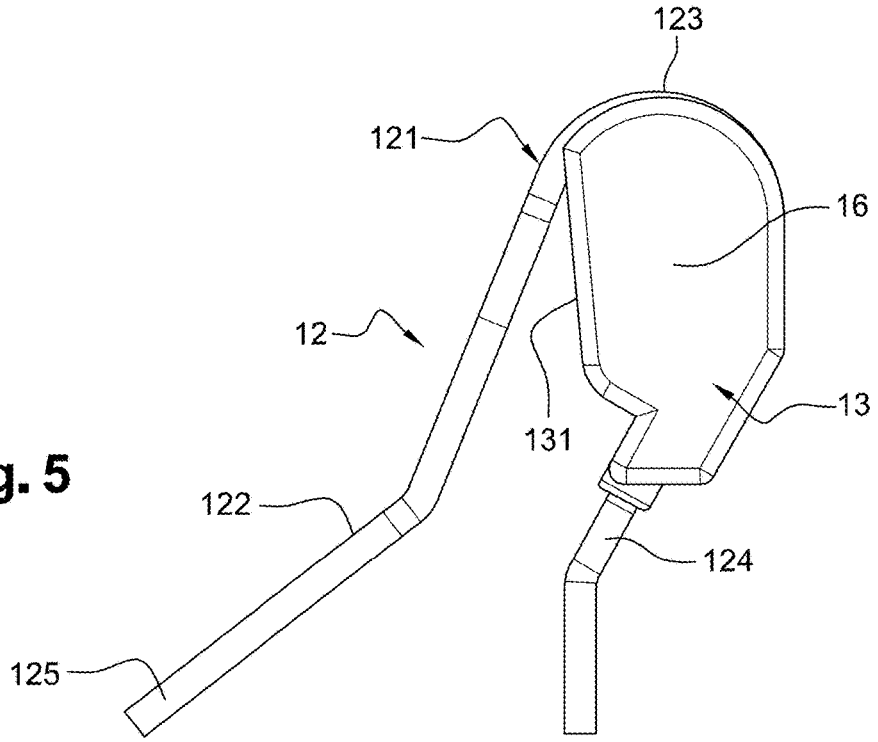
FIG. 5 is a front view of the contact spring and the support clip shown in FIGS. 1 to 4.

With reference to the appended FIGS. 1 to 8 as briefly described hereinabove, the invention essentially concerns an electrical apparatus such as an electrical contactor, comprising a casing 10 made of an electrically insulating material. The electrical apparatus also comprises a conductive bar 11 mounted in the casing 10 and intended to ensure an electrical connection function. The electrical apparatus also comprises at least one push-in type connection terminal mounted in the casing and comprising a contact spring 12 having an elastic portion 121 undergoing an elastic deformation under the action of an external force applied on the contact spring 12:

- either by an electrical conductor (not represented) during its insertion at least at one first aperture of the casing 10 so as to place the electrical conductor in a contact position located between the contact spring 12 and the conductive bar 11 in order to establish an electrical connection between the electrical conductor and the conductive bar 11,
- or by a tool inserted into at least one second aperture of the casing 10 so as to open the contact spring 12 and release the electrical conductor in order to remove it out of its contact position.

In the case where the electrical apparatus is of the electrical contactor type, it may comprise a maneuvering element not represented, whose actuation selectively allows selectively establishing or interrupting an electrical continuity. The electrical apparatus may be configured to be fastened in a detachable manner on a fastening rail on which several electrical apparatuses may be mounted side by side, these electrical apparatuses being identical or not to each other.

The electrical apparatus may alternatively be configured so as to constitute a terminal block intended to connect two electrical elements to each other and for that purpose comprise all the equipment necessary for the provision of such an electrical apparatus.

Thus, the conductive bar 11 and the contact spring 12 are configured such that when the electrical conductor is inserted into the casing 10 at the first aperture, the elastic portion 121 of the contact spring 12 deforms so as to allow the contact spring 12 on the one hand to automatically open under the action of the insertion external force of the electrical conductor in order to allow placing the electrical conductor in the contact position, and on the other hand to exert a pressure force on the electrical conductor ensuring holding of the electrical conductor in its contact position In other words, the connection terminal being of the push-in type, the contact spring 12 is configured such that the contact between the electrical conductor and the conductive bar 11 results from a forced insertion of the electrical conductor in opposition to the action of the contact spring 12 and is automatically held by the contact spring 12 after the insertion of the electrical conductor. The insertion of the electrical conductor is practiced between a portion of the contact spring 12 and the conductive bar 11, such that the electrical conductor is directly clasped by and between these two parts. This is the aforementioned contact position.

This technology is also known in the technical field considered herein under the name of <<push-in>>.

For reasons of simplicity of reading the figures, the shape and the organization of the first and second apertures not being further limiting per se, the casing 10 is schematically illustrated and the first and second apertures are not represented.

The nature and the organization of the elastic portion 121 of the contact spring 12 are also not limiting and may be arbitrary since the contact spring 121 responds to the functions previously presented in general. The organization of the elastic portion 121 may be a function of the material and the shape of the contact spring 12, of the expected thickness of the electrical conductors to be held, of the desired pressure force to maintain the electrical conductor in its contact position, of the shape and design of the casing 10 and the conductive bar 11, etc.

The contact spring 12 is adapted to vary between a first rest configuration (represented in the figures) from which it may open under the effect of the insertion action of the electrical conductor so as to occupy a second configuration (not represented) in which the contact spring 12 exerts a pressure force of the electrical conductor against the conductive bar 11, and a third configuration in which the electrical conductor is free to be removed from the connection terminal. The variation of the contact spring 12 from a configuration to the other is practiced by an elastic deformation at its elastically deformable portion 121. The contact spring 12 is configured so as to be continuously biased towards the first configuration by elastic return of its material at the portion 121. The pressure force exerted on the electrical conductor by the contact spring 12 in its second configuration is adapted to ensure the holding of the electrical conductor in the connection terminal, in particular by clamping between the contact spring 12 and the conductive bar 11, in order to prevent its axial removal from the connection terminal.

As represented, the contact spring 12 is removably mounted on the conductive bar 11. The electrical conductor may, for example, come into an aperture 111 formed in the conductive bar 11 and be held by the contact spring 12 which is itself mounted on the conductive bar 11. The conductive bar 11 may comprise a contact portion 112 extending from an edge of the aperture 111 and directed in a direction opposite to the insertion direction of the electrical conductor in the aperture 111. The electrical conductor comes against the contact portion 112 when the contact spring 12 exerts the pressure force to hold it in the contact position. Moreover, the contact spring 12 and the conductive bar 11 comprise elements allowing fixing the contact spring 12 on an edge of the aperture 111 in a dismountable manner, for example via a snap-fitting system, equipping for that the contact spring 12 and/or the conductive bar 11.

As previously indicated, the casing 10 delimits at least one second aperture allowing the insertion of a tool (not represented) into the casing 10 such as a screwdriver until it comes against the contact spring 12 in an area thereof such that the passage of the contact spring 12 towards its third configuration results from a pressure action of the tool on this area of the contact spring 12, which corresponds to the external force in the case where it is applied not by the electrical conductor but by the tool, having an intensity higher than a predetermined value. This predetermined value depends on the design and organization of the contact spring 12.

According to an important feature, the electrical apparatus comprises a support clip 13 independent of the casing 10 and of the conductive bar 11, having fastening elements detailed below configured so as to be able to mount the support clip 13 on the contact spring 12, in particular reversibly. The support clip 13 is configured so as to delimit a bearing face 131 against which the contact spring 12 bears during the deformation of its elastic portion 121 under the action of the external force, in order to impose the manner in which the elastic portion 121 of the contact spring 12 spatially deforms and against which the contact spring 12 abuts in its maximum deformation state in order to limit the elastic deformation of the elastic portion 121 of the contact spring 12 below a predetermined value regardless of the intensity of the external force imposed by the electrical conductor or by the unlocking tool.

The predetermined value below which the elastic deformation is contained thanks to the support clip 13 depends in particular on the material, the shape and the thickness of the contact spring 12 in its elastic portion 121, but also on the shape of the support clip 13 at the bearing face 131 where it fills the function of guiding and limiting the elastic deformation.

In this document, <<limiting the elastic deformation>> corresponds in practice to ensuring that at any point of the elastic portion 121 of the contact spring 12, the values taken by the terms of the strain tensor remain individually lower than a corresponding predetermined value during the during the elastic deformation phase imposed by the mechanical force applied by the electrical conductor when the latter itself undergoes the insertion force or by the mechanical force applied by the unlocking tool.

The support clip 13 is made of an electrically insulating material, such as for example a plastic material for reasons of ease of manufacture.

Advantageously, the shape of the support clip 13 depends on the shape of the contact spring 12 and is not a function of the shape of the conductive bar 11.

Figure 6:
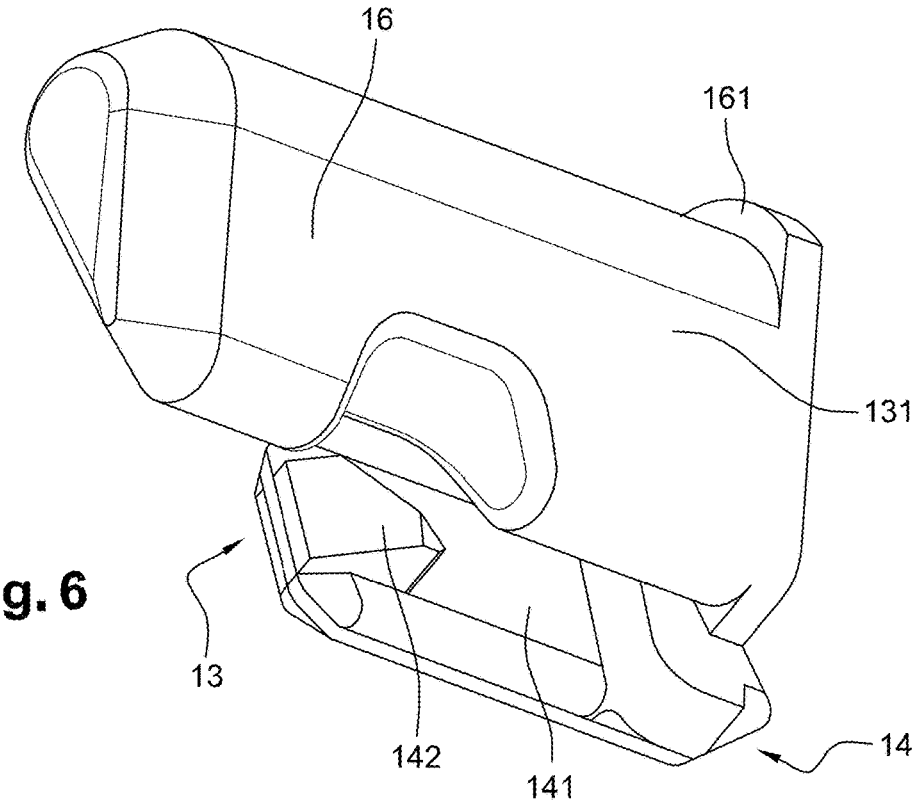
FIG. 6 is a perspective view of the support clip shown in FIGS. 1 to 5.

According to a particular embodiment, the support clip 13 is an integral single piece. This piece is independent and separated from the casing 10, from the conductive bar 11 and from the contact spring 12. FIG. 6 illustrates this independent piece, able to be mounted on the contact spring 12 and to be dismounted therefrom.

The support clip 13 and the contact spring 12 are configured such that the support clip 13 is fixed on the contact spring 12 by a relative displacement of the support clip 13 relative to the contact spring 12 in a lateral mounting direction substantially perpendicular to a deformation plane in which the contact spring 12 deforms during the elastic deformation of its elastic portion 121 under the action of the external force.

The shape of the contact spring 12 is not limiting in itself, it will depend in particular on that of the conductive bar 11 or the electrical conductor to be inserted and held. However, it has been found that good results are achieved by providing that the contact spring 12 comprises at least one elongated blade 122, where all or part of the elastic portion 121 of the contact spring 12 is arranged. The support clip 13 is fastened on said at least one blade 122 so as to occupy a functional position relative to the blade 122 in which the support clip 13 blocks and limits the elastic deformation of the blade 122 when the elastic portion 121 of the contact spring 12 deforms under the action of the external force.

The spatial organization of each blade 122 may be arbitrary since it allows filling its general function such as presented here. The contact spring 12 comprising at least one such blade 122, each of its blades 122 may be bent along its length so as to delimit an elbow 123, as is the case in the figures. The angle adopted by the elbow 123 of each blade 122 may in particular be in the range of 180°. The support clip 13 is then housed in this elbow 123 when it occupies its operative position.

The free end 125 of each blade 122 constitutes the portion of the contact spring 12 intended to bear against the electrical conductor in the second configuration of the spring 12. At least the elbow 123 of each blade 122 forms the elastic portion dedicated to the passage from one configuration to the other of the contact spring 12. A <<blade>> corresponds to a substantially elongated portion, having a dimension larger than the other dimensions, assimilable to its length. The longitudinal direction X of the blade 122 locally corresponds to the extension or elongation direction of the blade 122, according to which the length is considered. The smallest dimension of the blade 122, assimilable to its thickness, is locally measured in the transverse direction Z of the blade 122. The direction simultaneously perpendicular to the longitudinal direction X of the blade 122 and to its transverse direction Z is the lateral direction Y of the blade 122. The dimension of the blade 122, measured in the lateral direction Y of the blade 122, is assimilable to the width of the blade 122. The length of the blade 122 in the longitudinal direction X is much greater than the width of the blade 122 in its lateral direction Y, itself being much greater than the thickness of the blade 122 measured in the transverse direction Z.

The aforementioned deformation plane, in which the contact spring 12 deforms during the application of the external force is a plane orientated in the longitudinal direction X and the transverse direction Z. The lateral direction Y is perpendicular to this deformation plane.

In this context, the support clip 13 is mounted on the at least one blade 122 in the lateral direction Y of this blade 122 until it occupies its operative position, this displacement being perpendicular to the deformation plane of the contact spring 12. More specifically, a main body 16 of the support clip 13 is inserted into the elbow 123 formed in each of the blades 122 in their lateral direction Y. In this movement, the main body 16 abuts against one of the lateral edges of one of the blades 122 at a stop 161 of the main body 16 when it reaches the insertion end position, so that the operative position of the support clip 13 corresponds to an exactly predetermined spatial position relative to the contact spring 12.

The bearing face 131 of the support clip 13 as described, substantially operating in the manner of a cam towards each blade 122 of the spring 12 during its elastic deformation under the effect of the external force, corresponds to one or more of the outer faces of the main body 16. The cross-section of the main body 16 in the plane (X, Z), perpendicular to the lateral direction Z, is at least partly shaped complementary to the inner face of the elbow 123 of the blades 122, allowing participating in the fastening of the support clip 13 on the contact spring 12 as a complement to the stop 161.

Although the nature and organization of the fastening elements of the support clip 13 on the contact spring 12 may be arbitrary and are not limiting, the represented embodiment is advantageous in terms of simplicity and effectiveness by providing that the fastening elements comprise coupling elements 14 in the shape of a hook secured to the support clip 13 and arranged to reversibly hook into a complementary zone of the contact spring 12.

More specifically, the hook-shaped coupling elements 14 are connected to the main body 16, in particular at its end equipped with the stop 161. They comprise a wall 141 substantially parallel to the main body 16 and separated therefrom by a gap large enough to be greater than the thickness of the blades 122 and allow their placement between the main body 16 and the wall 141, thus constituting the general shape of the hook.

In the embodiment of FIGS. 1 to 6, the coupling elements further comprise a retaining lug 142 (visible in FIG. 6) protruding from the wall 141 in the direction of the main body 16. The function of this retaining lug 142, which is optional and absent in the two embodiments respectively of FIGS. 7 and 8, is to constitute a stop for the support clip 13 in a direction opposite to the stop 161, in order to axially block the movement of the support clip 13 in both ways in the contact spring 12 along the lateral direction Y of the blades 122.

Figure 7:
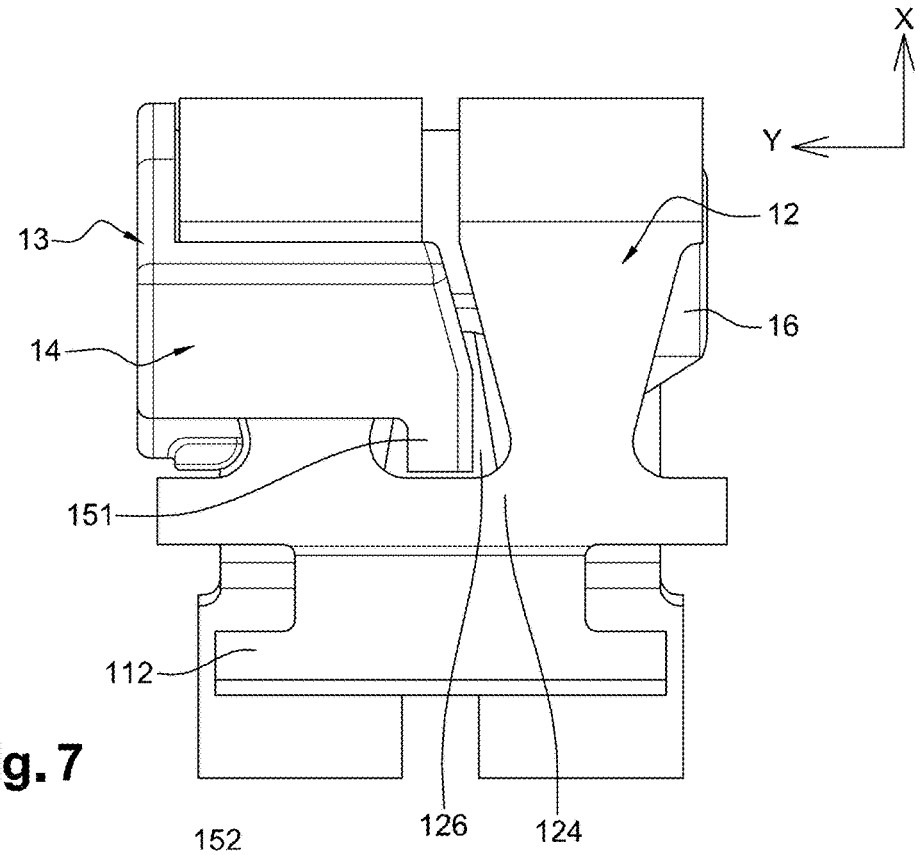
FIG. 7 is a side view of the assembly constituted by the conductive bar, the contact spring and the support clip of a second example of an electrical apparatus according to the invention.
Figure 8:
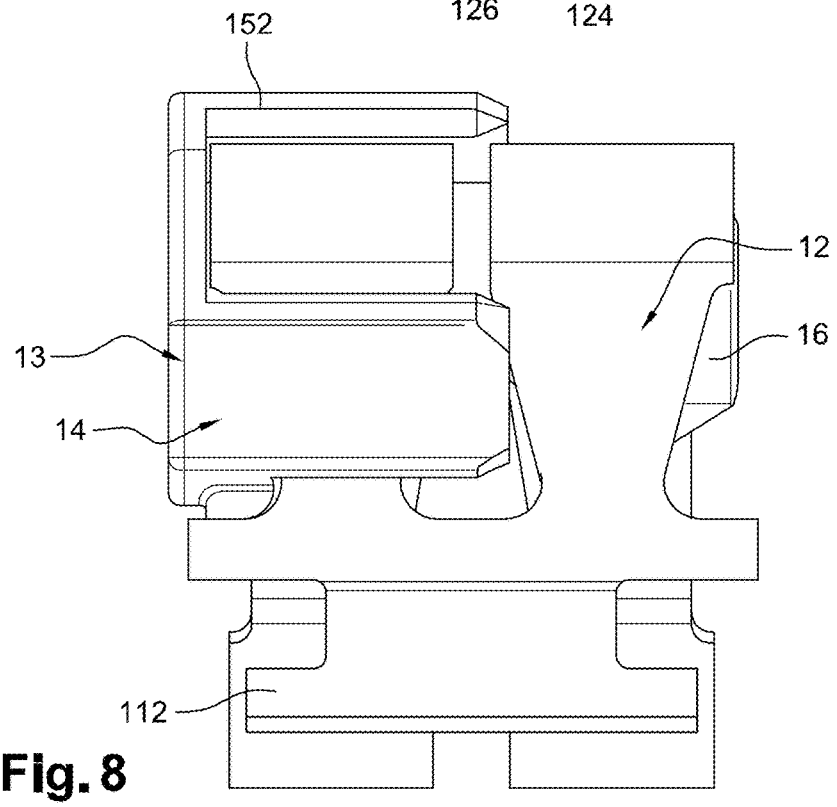
FIG. 8 is a side view of the assembly constituted by the conductive bar, the contact spring and the support clip of a third example of an electrical apparatus according to the invention.

In the embodiments of FIGS. 7 and 8 now, the fastening elements of the support clip 13 on the contact spring 12 also comprise at least one bearing element secured to the support clip 13 configured to press against the contact spring 12 so as to prevent the tilting of the support clip 13 relative to the contact spring 12 under the effect of the weight of the support clip 13.

In the embodiment of FIG. 7, the bearing element is constituted by a protuberance 151 of the support clip 13 configured to bear against a portion of the contact spring 12 projecting relative to said at least one blade 122 in the lateral direction Y of the blade 122, this bearing being exerted in the longitudinal direction X of the blade 122. In particular, the protuberance 151 is integral with the rest of the support clip 13.

As illustrated in FIG. 7, the protuberance 151 may, for example, project from the end of the wall 141 and being orientated substantially in the same plane as the wall 141.

Although it is possible that the number of blades 122 is strictly equal to 1 or greater than 3, the represented variant provides that the contact spring 12 comprises two blades 122 connected to each other by a connection portion 124, at their ends opposite to the free ends 125. The portion of the spring 12 against which the protuberance 151 bears is arranged at this connection portion 124 between the two blades 122. The protuberance 151 of the clip 13 is inserted into a slot 126 separating the two blades 122 from each other in the lateral direction Y of the blades 122 and bears longitudinally against the connection portion 124 in order to avoid the tilting of the support clip 13 under the effect of its weight.

It is also mentioned that the mounting of the contact spring 12 on the conductive bar 11 is made at the connection portion 124 between the blades 122, this mounting taking place for example on a free edge of the aforementioned aperture 111, at which the electrical conductor occupies its contact position.

Alternatively or in a combinable manner, the embodiment of FIG. 8 provides that the bearing element is constituted by an external cap 152 of the support clip 13 configured to surround the elbow 123 delimited by each blade 122 and bearing on the outer face of the elbow 123, this support being exerted in the transverse direction Z of the blade 122.

This external cap 152 is secured to the rest of the clip 13 and is connected to the main body 16 proximate to its stop 161. It is substantially parallel to the main body 16 and separated therefrom by a gap large enough to be greater than the thickness of the blades 122 and allow their placement between the main body 16 and the external cap 152 in their lateral direction Y.

In a not illustrated manner, the casing 10 may comprise two portions assembled to one another in a mounting direction 17 (FIG. 1) orientated substantially parallel to the direction of displacement of the electrical conductor during its insertion to its contact position.

The casing 10 comprises for example a peripheral wall and a cover configured so as to be assembled to one another in a mounting direction 17 substantially parallel to the direction in which the electrical conductor is inserted into the connection terminal. The assembly of the cover with the peripheral wall may be made by any adapted mechanism such as a snap-fitting, screwing system, or equivalent.

Although this arrangement allows addressing many problems and shortcomings of the existing solutions, this mounting direction 17 thus orientated is optional and it remains possible to provide that the two portions of the casing 10 are configured so as to be assembled to each other in a mounting direction substantially perpendicular to the insertion direction of the electrical conductor in the connection terminal.

Moreover, according to a particular embodiment, the mounting direction of the assembly constituted by the contact spring 12 and the support clip 13 assembled to each other in order to mount them in the casing 10 is orientated substantially parallel to the direction of displacement of the electrical conductor during its insertion to its contact position. Once again, this optional arrangement allows guaranteeing the function of limiting and guiding the deformation of the elastic portion 121 of the contact spring 12 even in the case where the two portions of the casing 10 are assembled to each other substantially parallel to the insertion direction of the electrical conductor into the casing 10 and into the connection terminal.

The invention which has just been described is an alternative solution to those of the prior art allows a reduction in costs, bulk and weight. It is simple in design and use, while being user-friendly and ergonomic in practice.

The support clip 13 provides all the necessary security against the risks of damage to the contact spring 12 under the effect of the different external forces applied on the contact spring 12 in the insertion and removal phases of the electrical conductor: it avoids in particular any risk of plastic deformation thanks to the function of guiding and limiting the elastic deformation.

Advantageously, each connection terminal is of the push-in type, which allows achieving the above desired results in a very effective manner, in particular when the two portions of the casing 10 have to be assembled in the same direction as the insertion direction of the electrical conductor into the connection terminal, which is frequently the case for the electrical contactors. The means allowing securing the contact spring 12 against the risks of plastic deformation, that is to say in this instance the support clip 13, allow very advantageously mounting the push-in type connection terminal and the conductive bar 11 in the casing 10 otherwise than laterally, in particular in the same direction as the direction in which the electrical conductor is inserted into the connection terminal and that the two portions of the casing 10 are assembled to each other.

What is claimed is:

1. An electrical apparatus such as an electrical contactor or a terminal block, comprising a casing made of an electrically insulating material, a conductive bar mounted in the casing and at least one push-in type connection terminal comprising a contact spring having an elastic portion undergoing an elastic deformation under the action of an external force applied on the contact spring by an electrical conductor during its insertion at a first aperture of the casing so as to place the electrical conductor in a contact position located between the contact spring and the conductive bar in order to establish an electrical connection between the electrical conductor and the conductive bar, or by a tool inserted into a second aperture of the casing so as to open the contact spring and release the electrical conductor in order to remove it out of its contact position, the electrical apparatus comprising a support clip independent of the casing and of the conductive bar, having fastening elements allowing mounting of the support clip on the contact spring and delimiting a bearing face against which the contact spring bears during the deformation of its elastic portion under the action of the external force in order to impose the manner in which the elastic portion spatially deforms and against which the contact spring abuts in its maximum deformation state in order to limit the elastic deformation of the elastic portion of the contact spring below a predetermined value regardless of the intensity of the external force.

2. The electrical apparatus according to claim 1, characterized in that the fastening elements of the support clip comprise at least one bearing element secured to the support clip configured to bear against the contact spring in order to prevent the tilting of the support clip relative to the contact spring under the effect of the weight of the support clip.

3. The electrical apparatus according to claim 1, characterized in that the casing comprises two portions assembled to one another in a mounting direction orientated substantially parallel to the direction of displacement of the electrical conductor during its insertion until its contact position.

4. The electrical apparatus according to claim 1, characterized in that the mounting direction of the assembly constituted by the contact spring and the support clip assembled to each other into the casing is orientated substantially parallel to the direction of displacement of the electrical conductor during its insertion until its contact position.

5. The electrical apparatus according to claim 1, characterized in that the support clip is an integral single piece.

6. The electrical apparatus according to claim 5, characterized in that the fastening elements comprise coupling elements in the form of a hook secured to the support clip and arranged to be reversibly hooked into a complementary area of the contact spring.

7. The electrical apparatus according to claim 1, characterized in that the fastening elements comprise coupling elements in the form of a hook secured to the support clip and arranged to be reversibly hooked into a complementary area of the contact spring.

8. The electrical apparatus according to claim 7, characterized in that the support clip and the contact spring are configured such that the support clip is fixed on the contact spring by a relative displacement of the support clip relative to the contact spring in a lateral mounting direction substantially perpendicular to a deformation plane in which the contact spring deforms during the elastic deformation of its elastic portion under the action of the external force.

9. The electrical apparatus according to claim 1, characterized in that the support clip and the contact spring are configured such that the support clip is fixed on the contact spring by a relative displacement of the support clip relative to the contact spring in a lateral mounting direction substantially perpendicular to a deformation plane in which the contact spring deforms during the elastic deformation of its elastic portion under the action of the external force.

10. The electrical apparatus according to claim 9, characterized in that the contact spring comprises at least one elongated blade where all or part of the elastic portion of the contact spring is arranged and in that the support clip is fastened on said at least one blade in order to occupy an operative position relative to the blade in which the support clip blocks and limits the elastic deformation of the blade when the elastic portion of the contact spring deforms under the action of the external force.

11. The electrical apparatus according claim 10, characterized in that the support clip is mounted on said at least one blade in a lateral direction (Y) of said blade until it occupies its operative position.

12. The electrical apparatus according to claim 11, characterized in that said at least one blade is bent along its length so as to delimit an elbow, in particular in the range of 180°, and in that the support clip is housed in said elbow when it occupies its operative position.

13. The electrical apparatus according to claim 12, characterized in that the fastening elements of the support clip comprise at least one bearing element secured to the support clip configured to bear against the contact spring in order to prevent the tilting of the support clip relative to the contact spring under the effect of the weight of the support clip.

14. The electrical apparatus according to claim 13, characterized in that the bearing element is constituted by a protuberance of the support clip configured to bear against a portion of the contact spring projecting relative to said at least one blade in a direction (Y) lateral to the blade, said bearing being exerted in a longitudinal direction (X) of the blade.

15. The electrical apparatus according to claim 13, characterized in that the bearing element is constituted by an external cap of the support clip configured to surround the elbow delimited by said at least one blade and to bear on the outer face of said elbow, said bearing being exerted in a transverse direction (Z) of the blade and wherein the casing comprises two portions assembled to one another in a mounting direction orientated substantially parallel to the direction of displacement of the electrical conductor during its insertion until its contact position and wherein the mounting direction of the assembly constituted by the contact spring and the support clip assembled to each other into the casing is orientated substantially parallel to the direction of displacement of the electrical conductor during its insertion until its contact position.

16. The electrical apparatus according to claim 1, characterized in that the contact spring comprises at least one elongated blade where all or part of the elastic portion of the contact spring is arranged and in that the support clip is fastened on said at least one blade in order to occupy an operative position relative to the blade in which the support clip blocks and limits the elastic deformation of the blade when the elastic portion of the contact spring deforms under the action of the external force.

17. The electrical apparatus according claim 16, characterized in that the support clip is mounted on said at least one blade in a lateral direction (Y) of said blade until it occupies its operative position.

18. The electrical apparatus according to claim 16, characterized in that said at least one blade is bent along its length so as to delimit an elbow, in particular in the range of 180°, and in that the support clip is housed in said elbow when it occupies its operative position.

19. The electrical apparatus according to claim 16, characterized in that the bearing element is constituted by a protuberance of the support clip configured to bear against a portion of the contact spring projecting relative to said at least one blade in a direction (Y) lateral to the blade, said bearing being exerted in a longitudinal direction (X) of the blade.

20. The electrical apparatus according to claim 16, characterized in that the bearing element is constituted by an external cap of the support clip configured to surround the elbow delimited by said at least one blade and to bear on the outer face of said elbow, said bearing being exerted in a transverse direction (Z) of the blade.

* * * * *